US006571805B2

(12) United States Patent
Hoenisch et al.

(10) Patent No.: US 6,571,805 B2
(45) Date of Patent: Jun. 3, 2003

(54) MULTI-CONTAINER PRESSURE WASHER AND RELATED PRODUCT SELECTING VALVE

(75) Inventors: Herb Hoenisch, Waukesha, WI (US); Peter Nushart, Waukesha, WI (US); Wes Sodemann, Dousman, WI (US)

(73) Assignee: Briggs & Stratton Power Products Group, LLC, Jefferson, WI (US)

( * ) Notice: Subject to any disclaimer, the term of this patent is extended or adjusted under 35 U.S.C. 154(b) by 0 days.

(21) Appl. No.: 09/999,421

(22) Filed: Nov. 15, 2001

(65) Prior Publication Data

US 2002/0033185 A1 Mar. 21, 2002

Related U.S. Application Data

(63) Continuation of application No. 09/246,886, filed on Feb. 8, 1999, now abandoned.

(51) Int. Cl.[7] ..... B08B 3/02

(52) U.S. Cl. ..... 134/22.12; 134/95.3; 134/103.2; 134/109.1; 134/172; 134/198; 239/101; 239/146; 239/302

(58) Field of Search ..... 134/94.1, 95.1, 134/95.3, 103.2, 104.1, 172, 198; 239/101, 146, 172, 303, 380

(56) References Cited

U.S. PATENT DOCUMENTS

| | | | | |
|---|---|---|---|---|
| 944,598 | A | | 12/1909 | Caskey |
| 1,515,768 | A | | 11/1924 | Damon |
| 1,547,545 | A | | 7/1925 | Wood |
| 1,702,982 | A | | 2/1929 | Schoder |
| 1,758,552 | A | | 5/1930 | Allen et al. |
| 1,843,099 | A | | 1/1932 | Johnson |
| 2,003,847 | A | | 6/1935 | Woods |
| 2,558,628 | A | | 6/1951 | Redin |
| 2,680,455 | A | | 6/1954 | Raiteri |
| 2,854,027 | A | | 9/1958 | Kaiser et al. |
| 3,037,707 | A | * | 6/1962 | Ligon |
| 3,315,691 | A | | 4/1967 | Widner |
| 3,322,350 | A | * | 5/1967 | Heinicke et al. |
| 3,454,030 | A | | 7/1969 | Nelson |
| 3,504,858 | A | | 4/1970 | Liddiard |
| 3,586,049 | A | | 6/1971 | Adamson |
| 3,610,535 | A | | 10/1971 | Bradshaw |
| 3,680,786 | A | | 8/1972 | Levy |
| 3,685,535 | A | * | 8/1972 | Cabel et al. |
| 3,784,050 | A | | 1/1974 | Pollack |
| 3,797,744 | A | | 3/1974 | Smith |
| 3,829,024 | A | | 8/1974 | Heden |
| 4,112,535 | A | | 9/1978 | Wild et al. |
| 4,290,442 | A | | 9/1981 | Shaffer |
| 4,309,788 | A | | 1/1982 | Brager et al. |
| 4,554,942 | A | | 11/1985 | Williams et al. |
| 4,638,949 | A | | 1/1987 | Mancel |
| 4,773,592 | A | | 9/1988 | Oberdorfer |
| 4,821,958 | A | * | 4/1989 | Shaffer |

(List continued on next page.)

*Primary Examiner*—Frankie L. Stinson
(74) *Attorney, Agent, or Firm*—Michael Best & Friedrich LLP

(57) ABSTRACT

A pressure washer includes a chassis as well as a liquid pump, a pump-driving prime mover, plural chemical product containers and a product selecting valve, all supported by the chassis. Each of the containers is attached to a separate valve conduit extending to the valve and the valve is connected to a device conduit extending to the mixing device. A distributor is mounted for movement with respect to the valve body and has a channel for selectively connecting one of the valve conduits to the device conduit. The user may thereby use the pressure washer to dispense any one of plural solutions. A fresh water container facilitates "wash out" of the valve and device conduit before switching to another chemical product.

13 Claims, 8 Drawing Sheets

U.S. PATENT DOCUMENTS

| | | | | |
|---|---|---|---|---|
| 4,967,960 | A | | 11/1990 | Futrell |
| 4,991,608 | A | | 2/1991 | Schweiger |
| 5,086,978 | A | | 2/1992 | Fertig |
| 5,238,191 | A | * | 8/1993 | Gaymon |
| 5,311,892 | A | | 5/1994 | Adelt et al. |
| 5,351,875 | A | | 10/1994 | Rhine et al. |
| 5,383,605 | A | * | 1/1995 | Teague |
| 5,409,032 | A | | 4/1995 | Berfield |
| 5,421,900 | A | | 6/1995 | Clontz |
| 5,584,327 | A | | 12/1996 | Thomas et al. |
| 5,653,261 | A | | 8/1997 | Dalhart et al. |
| 5,718,255 | A | | 2/1998 | Gilpatrick et al. |
| 5,816,272 | A | | 10/1998 | Leaphart |
| 5,897,297 | A | * | 4/1999 | Carter |
| 5,996,907 | A | | 12/1999 | Toetschinger et al. |

* cited by examiner

MULTI-CONTAINER PRESSURE WASHER AND RELATED PRODUCT SELECTING VALVE

This application is a continuation of application Ser. No. 09/246,886, filed Feb. 8, 1999, the entire content of which is incorporated herein by reference now abandoned.

FIELD OF THE INVENTION

This invention relates to fluid handling and, more particularly, to fluid handling systems, e.g., pressure washers, of the self-proportioning type.

BACKGROUND OF THE INVENTION

Pressure washers are widely known and widely used for such tasks as washing and wax-coating motor vehicles, preparing a building for painting, washing walkways and a host of similar tasks. Examples of pressure washers are disclosed in U.S. Pat. Nos. 5,409,032 (Berfield) and 5,718,255 (Gilpatrick et al.).

While pressure washers can be used with water alone (and are quite effective when so used), it is often desirable to mix a chemical product, e.g., a detergent, with water. The resulting solution is even more effective than plain water for certain purposes.

While certain types of pressure washers include a container for a chemical product, such pressure washers are disadvantageous for certain uses. Particularly, the user of the washer may, at different times, desire to use a detergent solution, an auto wax solution, a deck wash solution, as but a few examples. If the user desires to switch from one chemical product to another, it is preferred that the product container and all of the related tubing be first washed out with water. In other words, it is not a good idea (and may be self-defeating) to place an auto wax product into a container having detergent residue in it.

But insofar as is now known, there are no pressure washers which offer the product features and configuration which permit the user to quickly switch from one chemical product to another while yet avoiding diluting or impairing the quality of a product with residue from a previously-used product. And insofar as is now known, there is no selector valve suitable for use on such a pressure washer.

Another disadvantage of certain types of pressure washers arises from the mechanism used to control pump output pressure. A typical arrangement uses a pressure control knob which bypasses water in the pump. The knob is less than entirely convenient to use and its rotational position gives no indication of pressure or is only casually related thereto.

A multi-container pressure washer and related product selecting valve which addresses shortcomings of the prior art would be a distinct advance in the field of pressure washers.

OBJECT OF THE INVENTION

It is an object of the invention to provide a multi-container pressure washer addressing shortcomings of prior art pressure washers.

Another object of the invention is to provide a multi-container pressure washer which permits a user to quickly switch between different chemical products.

Another object of the invention is to provide a multi-container pressure washer having a product selecting valve facilitating quickly switching between different chemical products.

Yet another object of the invention is to provide a multi-container pressure washer which includes an easy-to-use pressure control. How these and other objects are accomplished will become apparent from the following descriptions and from the drawings.

SUMMARY OF THE INVENTION

Aspects of the invention involve a pressure washer of the type including a wheeled chassis as well as a liquid pump, a pump-driving prime mover, and a liquid container, all supported by the chassis. The pump has a water inlet port and is coupled to a mixing device such as a venturi-type eductor mixer.

In the improvement, the washer has first and second containers and a product selecting valve, also supported by the chassis. Each of the containers is attached to a separate, i.e., first and second input or valve conduit extending to the valve. The valve is connected to an output or device conduit extending to the mixing device. In a specific, highly preferred embodiment, the pressure washer has a total of four containers, three for chemical products and one for fresh "conduit rinse-out" water.

To set up the pressure washer for use, a relatively small quantity of a different chemical is poured into each of the three chemical product containers. Herein, each such undiluted chemical is referred to as a "concentrate." A specified amount of water is then added to each such container (and to the chemical therein) and herein, each such moderately diluted substance is referred to as a "product." The fourth container is filled only with water.

The multi-container, valve-equipped pressure washer permits the user to select (by valve manipulation) any one of several products, e.g., a detergent product, a car wash product, a deck wash product, an automobile wax product, or a multi-purpose cleaning product to be mixed with water from the pump. Herein, when a product is mixed with water from the pump, the resulting liquid delivered to the spray wand is referred to as a "solution." The new pressure washer also permits the user to wash a product out of a conduit with fresh water from a separate water container before selecting another product to be mixed with the pumped water.

In more specific aspects of the invention, each of the containers includes a top fill neck and a neck cap or closure. The closures are "top-exposed," thereby providing free access to the containers closures for container filling. (Top-exposed closures means closures which are accessible without moving or removing any other component of the pressure washer.) And in a specific embodiment, the containers are of the same size and shape and the closures are in registry with the same horizontal plane.

In another aspect of the invention, the pressure washer has a third container—and, most preferably, a fourth container. Each of the first, second and third containers includes a different chemical product. And the fourth container holds only water.

A highly preferred pressure washer has features which make the washer very easy to use. As examples, the washer has a control console with a product selector device and a pressure selector device mounted with respect to such console. In a specific embodiment, the product selector device is a rotary knob and the pressure selector device is a linearly-actuated lever controlling the throttle of the prime mover engine. On the console, the lever is identified by mnemonic symbols (e.g., L, M and H) and/or by graphic symbols related to pressure. (Since the pump rotates at engine speed, changing such engine speed will also change output pressure at the spray wand.)

In yet another aspect of the invention, the valve has a body with first, second, third and fourth inlet apertures formed in it. First, second, third and fourth conduits, respectively, are connected to such apertures. The valve body also has an outlet aperture having a device conduit attached to it and extending from the outlet aperture to the mixing device. A distributor is mounted for movement, e.g., sliding or rotary movement, with respect to the valve body and has a channel for selectively connecting one of the conduits to the device conduit.

When the distributor is set to connect a particular inlet conduit to the device conduit, it is preferred that the distributor be restrained from moving from the selected position. To that end, the valve includes a position retention mechanism coacting between the distributor and the valve body. In an exemplary embodiment, the position retention mechanism includes a plurality of shallow detent pockets and a pocket engagement member, e.g. a ball or the like, which is spring biased toward the pockets.

In more specific aspects of the invention, the distributor is mounted for rotational movement about an axis of rotation. The first, second, third and fourth inlet apertures extend along first, second, third and fourth aperture axes, respectively. Such aperture axes have a fixed positional relationship with respect to the axis of rotation. In a highly preferred embodiment, such positional relationship of the aperture axes to the axis of rotation is substantially parallel thereto.

More particularly, such aperture axes define an arc of a circle. The outlet aperture extends along an outlet axis coincident with the circle center. (It is to be appreciated that in other valve embodiments involving, for example, a rotary or linearly sliding distributor, the positional relationship of the aperture axes to the axis of rotation may be angular thereto.

Yet other aspects of the invention involve additional features of the product selecting valve. As to one such feature, the valve has a dynamic sealing surface coacting between the body and the distributor. At least the first aperture axis is substantially parallel to the axis of rotation and the sealing surface is on an O-ring lodged between the body and the distributor. Such O-ring extends around the first aperture axis.

Other details of the invention are set forth in the following detailed description and in the drawings.

DETAILED DESCRIPTION OF PREFERRED EMBODIMENTS

Figure 1:
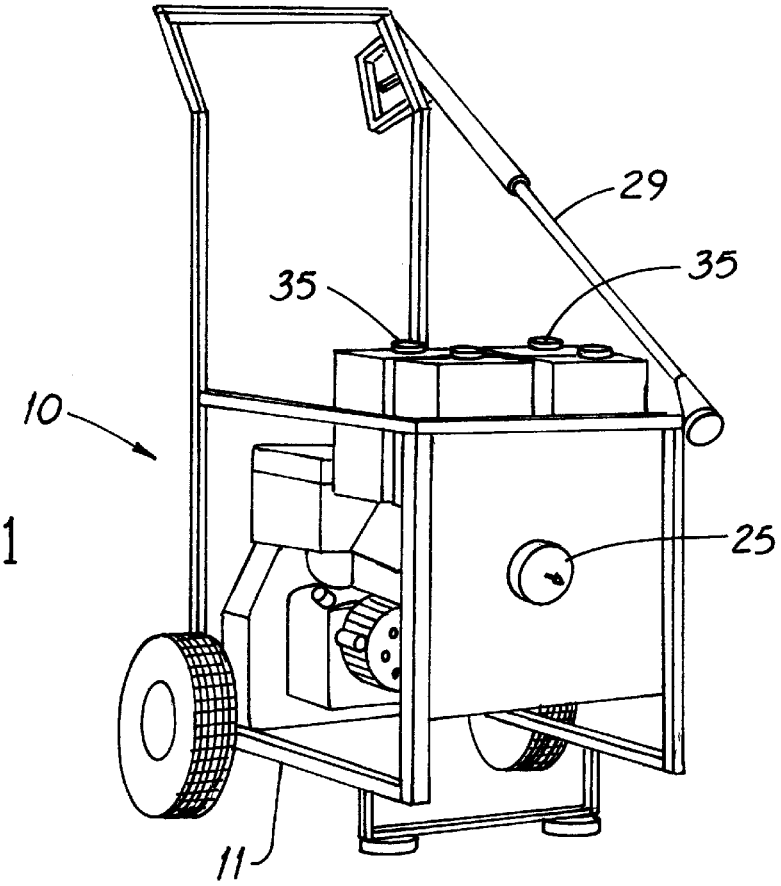
FIG. 1 is representative perspective view of the new pressure washer. Parts are broken away.

Referring first to FIGS. 1 through 4, aspects of the invention involve a pressure washer 10 having a wheeled chassis 11 as well as a liquid pump 13, a pump-driving prime mover 15 (e.g., an internal combustion engine), and a liquid container (such as container C1), all supported by the chassis 11. The pump 13 has a water inlet port 17 and is coupled to a mixing device 19 such as a venturi-type eductor mixer.

A highly preferred washer 10 has first, second, third and fourth containers C1, C2, C3, C4, respectively. All of the containers C1, C2, C3, C4 as well as the product selecting valve 21 are supported on and by the chassis 11. The multi-container, valve-equipped pressure washer 10 permits the user to select (by valve manipulation) any one of several chemical products, e.g., a detergent product, a car wash product, a deck wash product, an automobile wax product, or a multi-purpose cleaning product. In a specific embodiment of the washer 10, each of the first, second and third containers C1, C2, C3 contains or is intended to contain within it a different washing or waxing product (and, preferably, is suitably marked to designate such product). The fourth container C4 has "rinse-out" water in it and is so designated. In the pressure washer console 23 depicted in FIG. 4, the products (rather than the containers) are identified by the designators A, B and C adjacent to the selector device 25.

The mixing device 19 mixes the selected product with high-pressure water (flowing from the garden hose and pressurized by the pump 13) in appropriate proportion to form a washing or waxing solution of proper "strength." The solution is then directed along a hose 27 to a spray wand 29. Notably, the new pressure washer 10 is configured to permit one to use the rinse-out water in the fourth container C4 to wash a product out of a conduit 31 and the valve 21 using fresh water. Such "washing out" is highly preferred before selecting another product to be mixed with the pumped water.

Figure 2:
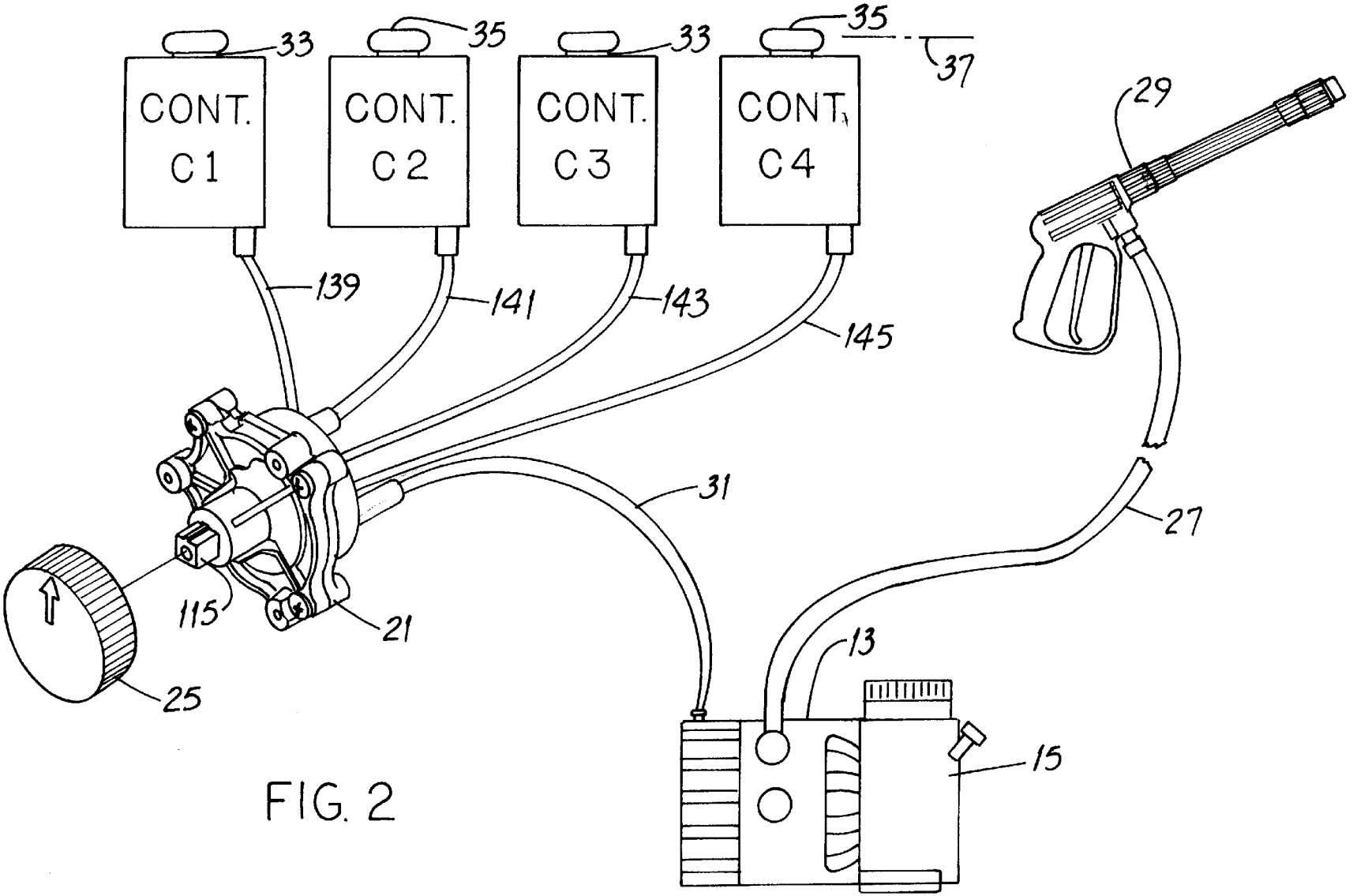
FIG. 2 is a pictorial view of the primary operative components of the pressure washer of FIG. 1. Parts are broken away.
Figure 17:
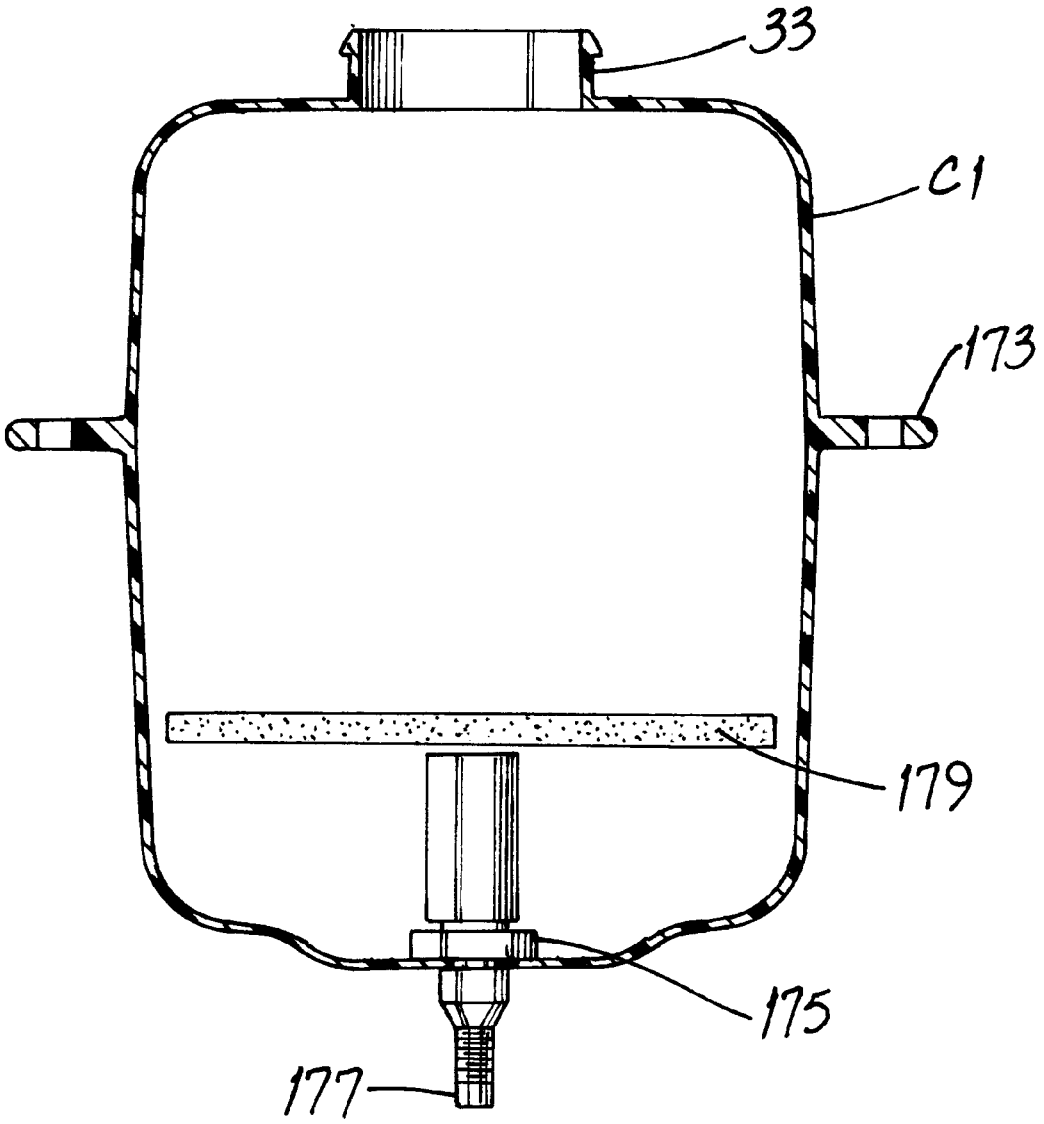
FIG. 17 is a sectional elevation view of a typical container used with the pressure washer.

Referring particularly to FIGS. 1, 2 and 17, each of the containers C1, C2, C3, C4 includes a top fill neck 33 and a neck cap or closure 35. The closures 35 are "top-exposed," thereby providing free access to the containers closures 35 for easy container filling. (Top-exposed closures 35 means closures 35 which are accessible for removal and pouring into the related container C1, C2, C3 and/or C4 without moving or removing any other component of the pressure washer 10.) And in a specific embodiment, the containers C1, C2, C3, C4 are of the same size and shape and the closures 35 are in registry with the same horizontal plane 37.

Referring particularly to FIGS. 2 and 17, a container such as container C1 has a pair of mounting ears 173, a lower tank connection bushing 175 and an outlet filter 177. It has been found that when the prime mover 15 is an internal combustion engine, the modest vibration causes a chemical product to splash past a closure 35. To substantially prevent this eventuality, at least each of the chemical product containers has therewithin a flexible, free-floating baffle member 179. Such baffle member, a pad made of rubber-like foam or the like, has a density well less than that of water (or of a chemical product) and floats thereon. The member 179 is placed in the container by crumpling it into a ball and pushing it through the neck 33, whereupon it resumes its original size and shape.

Figure 4:
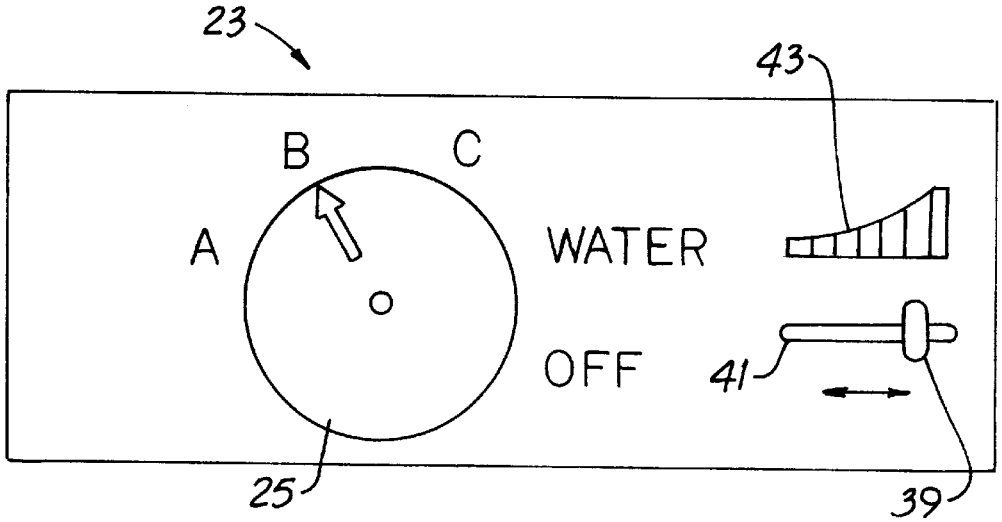
FIG. 4 is an elevation view of aspects of the operating console of the pressure washer of FIG. 1.

Referring now to FIGS. 1 and 4, a highly preferred pressure washer 10 has features which make the washer 10 very easy to use. As examples, the washer 10 has a control console 23 with a constituent selector device 25 and a pressure selector device 39 mounted on such console 23. In a specific embodiment, the constituent selector device 25 is a rotary knob and the pressure selector device 39 is a lever, e.g., a linearly actuated lever, which moves along a slot 41 and controls the throttle of the prime mover engine. Most preferably, the console 23 includes a graph 43 just above the pressure selector device 39 that visually indicates increasing pressure even though such device 39 controls the engine throttle. (Pressure along the hose 27 and at the wand 29 is generally proportional to the speed at which the pump 13 is driven.)

Figure 5:
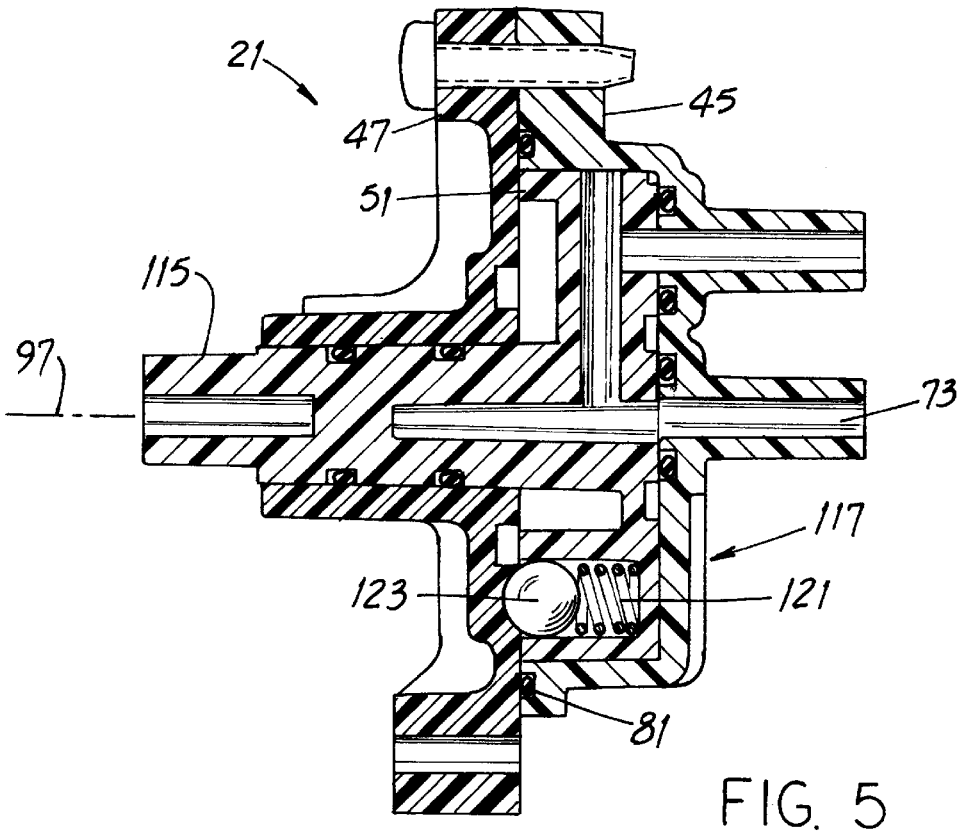
FIG. 5 is a cross-sectional elevation view of the rotary product selecting valve shown in FIGS. 2 and 3.

Further details of the product selecting valve 21 will now be set forth. Referring also to FIGS. 2 and 5–14, the valve 21 has a housing 45 and a housing cover 47. The housing 45 has a generally cylindrical cavity 49 formed in it and as further described below, a distributor 51 rotates in the cavity 49. Formed in the cavity floor 53 are first, second, third and fourth inlet apertures 55, 57, 59, 61, respectively. Each aperture 55, 57, 59, 61 is surrounded by a separate O-ring groove and such grooves are identified as first, second, third and fourth grooves 65, 67, 69, 71, respectively. The housing 45 also has an outlet aperture 73 surrounded by another O-ring groove, i.e., a fifth groove 75. The cavity 49 is bounded in part by a circumferential lip 77 and an O-ring groove 79 is formed in such lip 77. When the cover 47 and the housing 45 are assembled to one another as shown in FIG. 5, the O-ring 81 in the groove 79 seals between the housing 45 and cover 47.

In the specific embodiment shown in FIGS. 5 through 14, the inlet apertures 55, 57, 59, 61 extend along respective inlet axes 83, 85, 87, 89 and such axes 83, 85, 87, 89 are equidistant from the outlet axis 91. To state it another way, the inlet axes 83, 85, 87, 89 define an arc 93 of a circle and the outlet axis 91 is at the circle center. And the axes 83, 85, 86, 89 are parallel to one another.

Referring now to FIGS. 5 and 12–14 the valve distributor 51, sometimes referred to as a rotor in the illustrated embodiment, is lodged between the housing 45 and cover 47 and is rotatable with respect to both. The distributor 51 has a generally planar face 95 which bears against the housing 45 and the O-rings 81 in the grooves 65, 67, 69, 71, 75 and such face 95 is substantially perpendicular to the distributor axis of rotation 97. The distributor 51 also includes a circular shoulder 99 which bears against the cover 47. A ring-like, circumferential bearing surface 101 extends generally between the shoulder 99 and the face 95. The face 95, shoulder 99 and bearing surface 101 may be considered to be dynamic sealing surfaces since they seal during movement of distributor 51 with respect to the housing 45 and cover 47.

Referring particularly to FIGS. 5 and 12–14, the distributor 51 has an aperture connection channel 103, comprising paths 105, 107 and 109 which selectively connects one of the inlet apertures 55, 57, 59, 61 to the outlet aperture 73, depending upon the particular position to which the distributor 51 has been rotated. (Those portions of the paths 107, 109 at the locations 111, 113, respectively, do not form part of the channel 103 and play no role in aperture interconnection.)

Referring also to FIGS. 2, 3, 5 and 12–14, the distributor stem 115 has the selector device 25 mounted thereon. When the distributor 51 is set to connect a particular container C1, C2, C3, C4 to the mixing device 19, it is preferred that the distributor 51 be restrained from moving from the selected position. To that end, the valve 21 includes a position retention mechanism 117 coacting between the distributor 51 and the cover 47. In an exemplary embodiment, the position retention mechanism 117 includes a blind hole 119 ("blind" in that such hole 119 is open at only one end) in which is lodged a compression spring 121 and a ball 123 urged toward the cover 47 by such spring 121. The cover 47 has a plurality of shallow detent pockets 125, 127, 129, 131 and when the path 105 is aligned with a particular inlet aperture 55, 57, 59 or 61, the ball is aligned with a corresponding pocket 131, 129, 127, 125, respectively. When the selector device 25 is in the OFF position (see FIG. 4), the ball 123 is aligned with the pocket 133.

Figure 11:
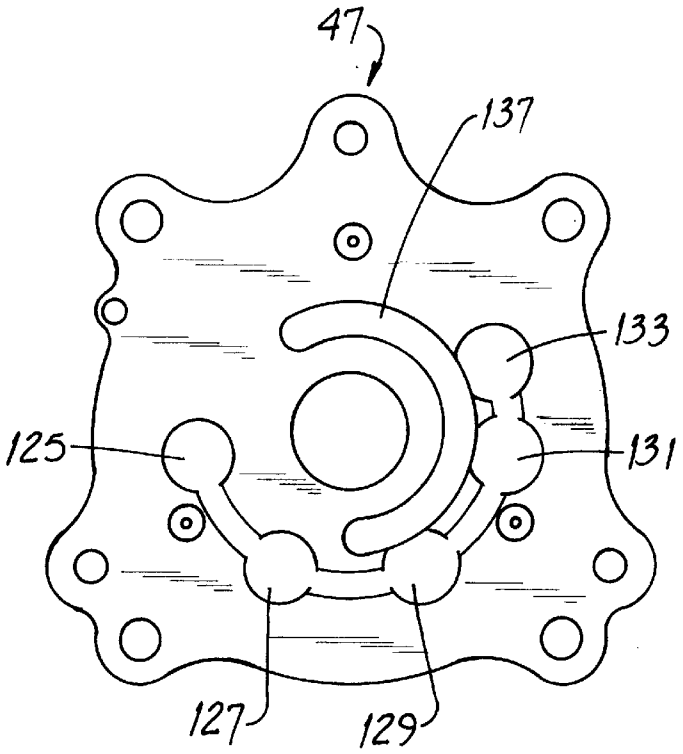
FIG. 11 is an elevation view, in full representation, of the cover shown in FIG. 9 taken in the viewing plane 11—11 thereof.
Figure 9:
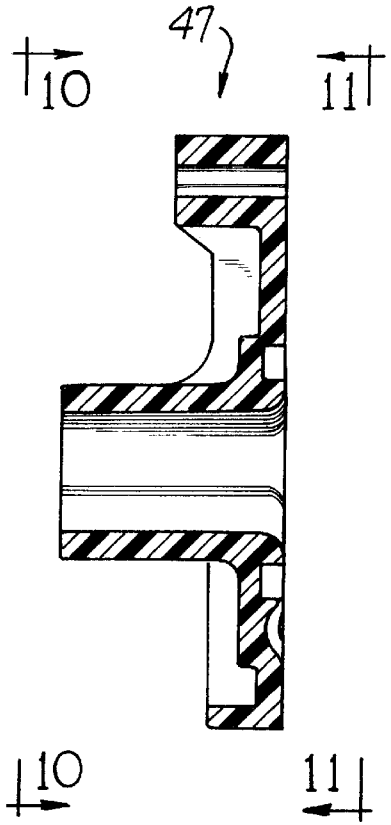
FIG. 9 is a cross-sectional elevation view of the cover of the product selecting valve shown in FIG. 5.
Figure 10:
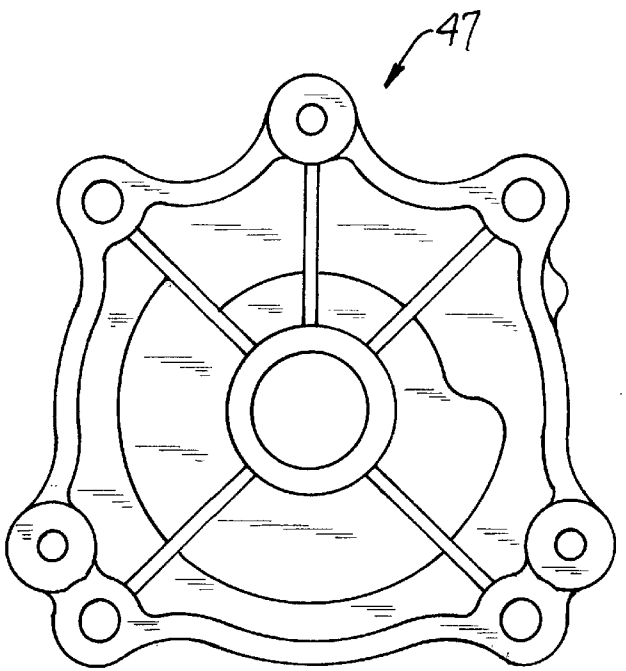
FIG. 10 is an elevation view, in full representation, of the cover shown in FIG. 9 taken in the viewing plane 10—10 thereof.
Figure 14:
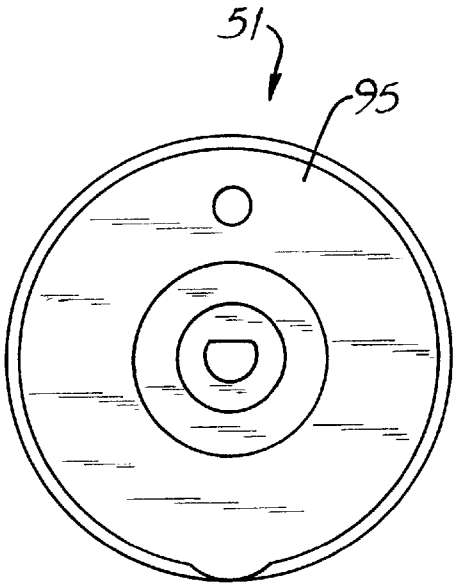
FIG. 14 is an elevation view, in full representation, of the distributor shown in FIG. 12 taken in the viewing plane 14—14 thereof.
Figure 12:
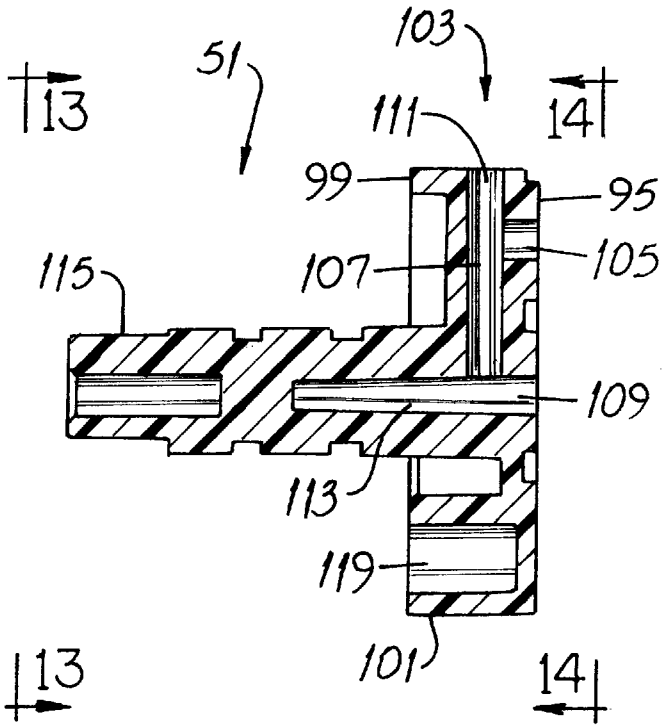
FIG. 12 is a cross-sectional elevation view of the rotatable distributor of the product selecting valve shown in FIG. 5.
Figure 13:
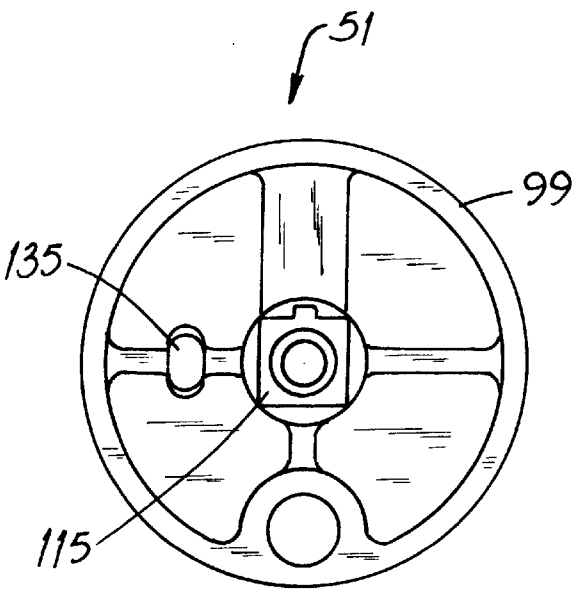
FIG. 13 is an elevation view, in full representation, of the distributor shown in FIG. 12 taken in the viewing plane 13—13 thereof.

Conveniently, the new valve 21 also includes structure which limits angular rotation of the distributor 51. Referring to FIGS. 11 and 13, the distributor 51 has a tang 135 protruding in the direction of the stem 115 and the cover 47 includes an arcuate stop groove 137 into which the tang 135 extends and in which the tang 135 moves. In a specific embodiment, the stop groove 137 has an arc length of about 210°. That is, radii extending from the cover center through respective ends of the groove define an arc of about 210° therebetween. When the valve 21 is so configured, the tang 135 and groove 137 cooperate to limit rotational travel of the distributor 51 to about 210°.

Figure 3:
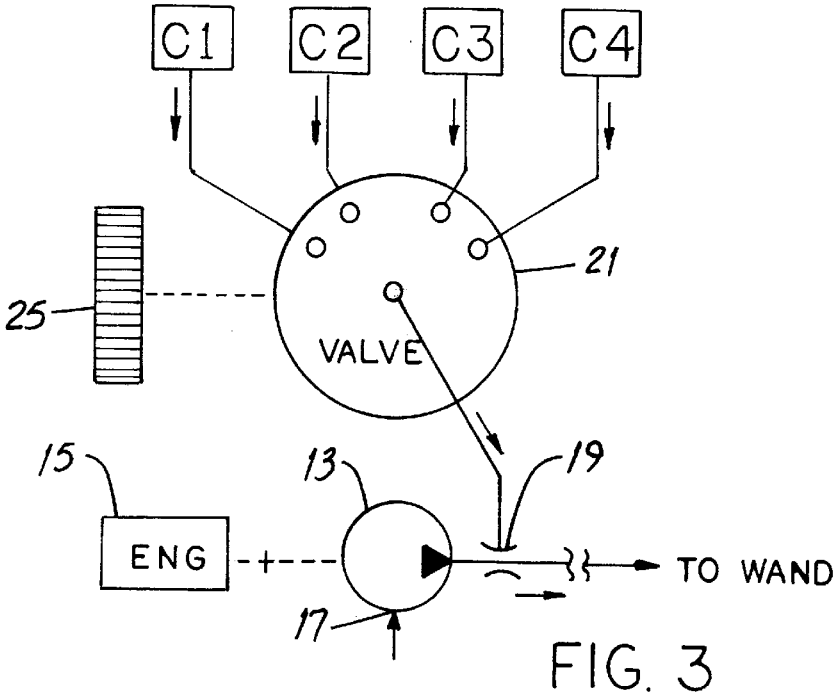
FIG. 3 is a diagrammatic view of components shown in FIG. 2.
Figure 8:
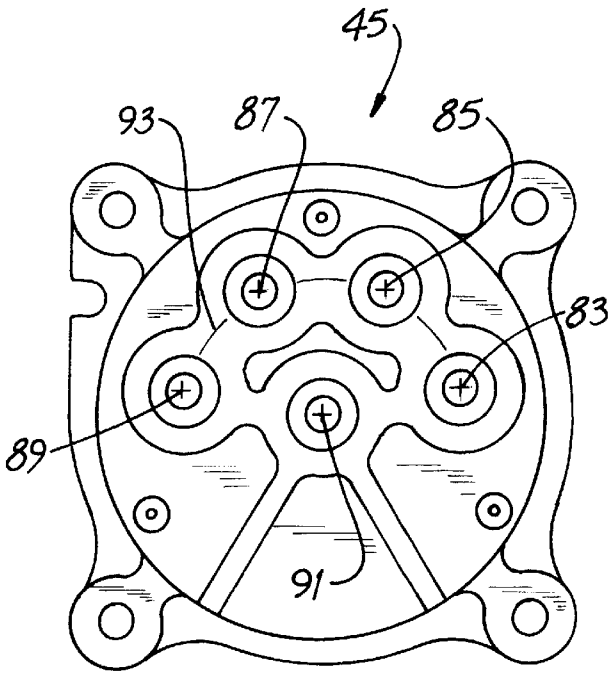
FIG. 8 is an elevation view, in full representation, of the housing shown in FIG. 6 taken in the viewing plane 8—8 thereof.
Figure 6:
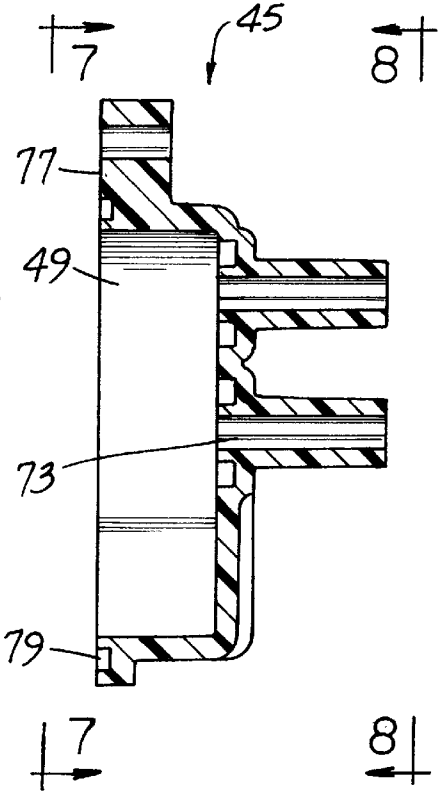
FIG. 6 is a cross-sectional elevation view of the housing of the product selecting valve shown in FIG. 5.
Figure 7:
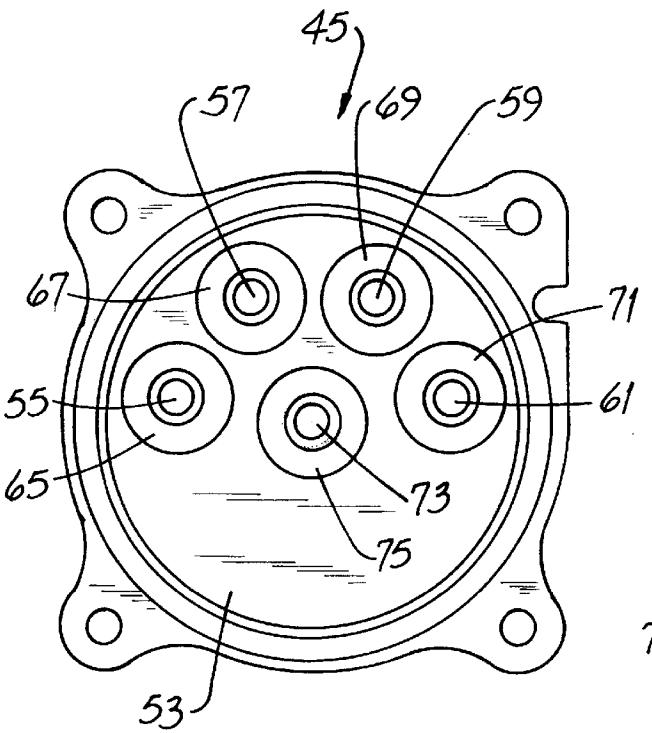
FIG. 7 is an elevation view, in full representation, of the housing shown in FIG. 6 taken in the viewing plane 7—7 thereof.

Referring now to FIGS. 2 and 3, each of the containers C1, C2, C3, C4 is attached to a separate valve conduit extending to the valve 21. Herein, such conduits are referred to as first, second, third and fourth conduits 139, 141, 143, 145, respectively, and in the assembled ready-to-use valve, the conduits 139, 141, 143, 145 are attached to the inlet apertures 55, 57, 59, 61, respectively. And the output or device conduit 31 is connected to and extends between the outlet aperture 73 and the mixing device 19.

In use, each of three different constituents is placed in the containers C1, C2 and C3 and water is placed in the container C4. The selector device 25 is rotated to select one of containers and a constituent or water flows from one of the containers C1, C2, C3 or C4 along one of the conduits 139, 141, 143 or 145 is mixed in the device 19 with water from the pump 13 and delivered to the wand 29 for washing, waxing or the like. Before selecting another constituent, the device 25 is rotated to select the water container C4 to wash out the channel 103 and the outlet aperture 73 and conduit 31. Thereafter, another constituent may be selected by device rotation. (No doubt, it is appreciated that the pressure washer 10 can be used with but a single constituent in any one of the containers C1, C2, C3. Preferably, no liquid other than water is placed in container C4.)

Figure 15:
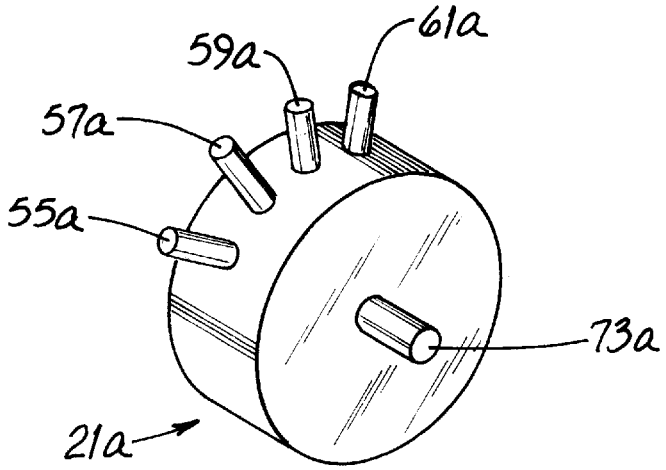
FIG. 15 is a representative perspective view of another embodiment of a rotary product selecting valve which is similar to the product selecting valve shown in FIGS. 2 and 5.

As described above, the highly preferred valve 21 is a rotary valve having axially-oriented inlet apertures 55, 57, 59, 61. Referring to FIG. 15, the rotary valve 21*a* may also be configured with radially-oriented inlet apertures 55*a*, 57*a*, 59*a*, 61*a* and an axial outlet aperture 73*a*.

Figure 16:
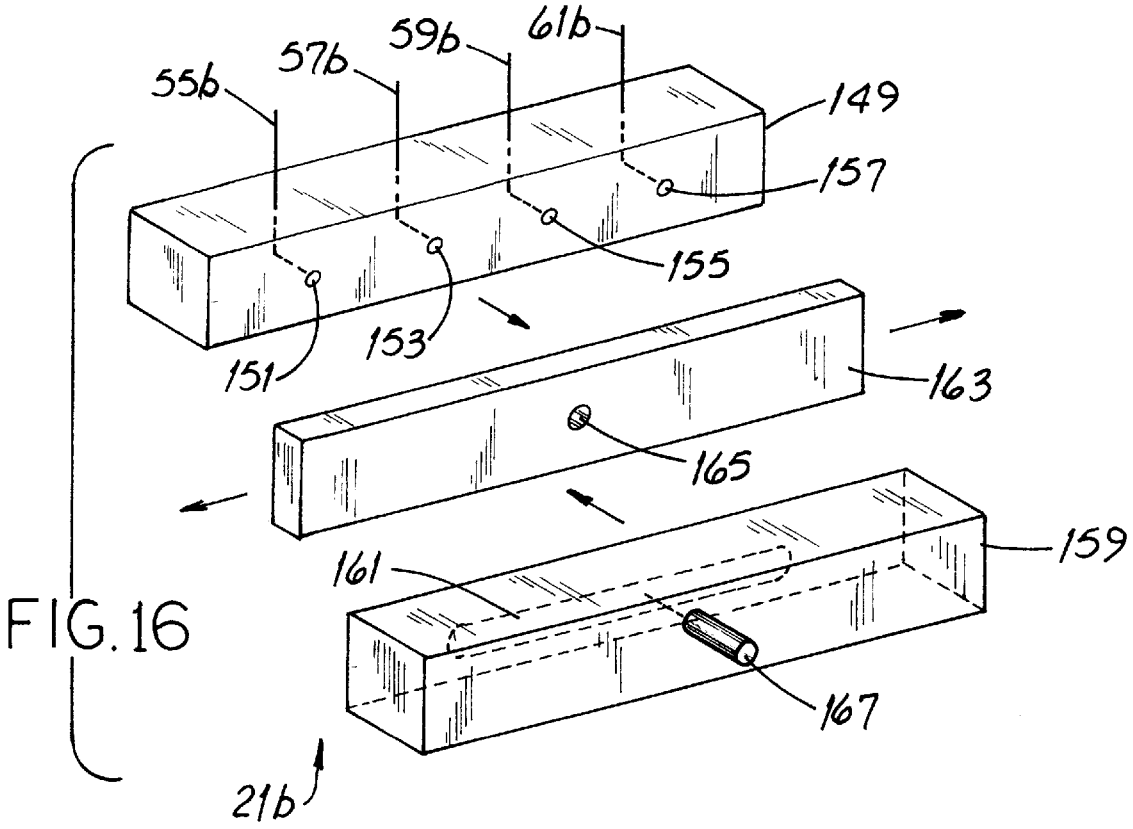
FIG. 16 is a representative perspective view, in exploded form, of a linear, sliding type of product selecting valve.

But a rotary valve 21, 21*a* is not the only type of valve suitable for use with the pressure washer 10. Referring to FIG. 16, a simplified, linearly-actuated slider valve 21*b* has a manifold plate 149 in which each inlet aperture 55*b*, 57*b*, 59*b*, 61*b* connects via a right-angle channel represented by dashed lines to a corresponding port 151, 153, 155, 157. An output plate 159 has an elongate channel 161 which is in registry with the ports when the valve 21*b* is assembled.

A selector plate 163 is mounted for sliding movement between the plates 149, 159 which are not relatively movable with respect to one another. The selector plate 163 has a pickup aperture 165 which is in registry with one of the ports 151, 153, 155, 157, depending upon the position of the plate 163. Irrespective of the position of the selector plate 163, the pickup aperture 165 is always in registry with the channel 161. Liquid entering any one of the apertures 55*b*, 57*b*, 59*b*, 61*b* is thereby connected vi the channel 161, to the outlet aperture 167 in the plate 159.

While the principles of the invention are shown and described in connection with preferred embodiments, it is to be understood clearly that such embodiments are by way of example and are not limiting.

What is claimed:

1. A pressure washer comprising:

a single pump fluidly connected to a primary water source;

a mixing device fluidly connected to the pump;

a valve including a device conduit fluidly connected to the mixing device;

first and second containers having respective first and second chemical products therein, a first conduit fluidly connecting the first container to the valve;

a second conduit fluidly connecting the second container to the valve; and a wash out assembly including a third container having water and a third conduit fluidly connecting the third container to the valve, wherein the valve is fluidly connected between the first, second, and third containers and the mixing device, the valve being adjustable to selectively place one of the first, second, and third containers in fluid flow communication with the mixing device through the device conduit such that the valve can be adjusted to fluidly connect the wash out assembly with the mixing device to flush out the valve and device conduit.

2. The pressure washer of claim 1, wherein the pump is fluidly connected to a water source.

3. The pressure washer of claim 1, wherein the mixing device is a venturi-type eductor mixer.

4. The pressure washer of claim 1, further comprising a chassis, wherein the pump, valve, and container are supported by the chassis.

5. The pressure washer of claim 1, wherein the chemical product of the first container is one of a detergent product, a car wash product, a deck wash product, an automobile wax product, and a multipurpose cleaning product, and the chemical product of the second container is a different one of a detergent product, a car wash product, a deck wash product, an automobile wax product, and a multipurpose cleaning product.

6. The pressure washer of claim 1, wherein the valve includes a valve body that is connected to the first, second, and third valve conduits and a distributor that is connected to the device conduit and mounted for movement relative to the valve body.

7. The pressure washer of claim 6, wherein the distributor includes a channel for selectively fluidly connecting one of the first, second, and third container to the mixing device.

8. The pressure washer of claim 6, wherein the valve includes a position retention mechanism between the distributor and the valve body to maintain the distributor at a selected position.

9. The pressure washer of claim 6, further comprising a pump driving prime mover that drives the pump and includes a throttle, the pressure washer further comprising a control console including a product selector device and a pressure selector device, wherein the product selector device is coupled to the control console and the distributor and adjusts the valve, and the pressure selector device is coupled to the control console and the throttle of the pump driving prime mover and adjusts the speed of the motor and the pump.

10. The pressure washer of claim 9, wherein the product selector device is a manually adjusted rotary knob.

11. The pressure washer of claim 9, wherein the pressure selector device is a manually linearly-actuated lever.

12. A method for washing out a pressure washer that includes a single pump fluidly connected to a primary water source, a mixing device that is fluidly connected to the pump, a valve having a device conduit fluidly connected to the mixing device, first and second containers having respective first and second chemical products therein, a first conduit fluidly connecting the first container to the valve, and a second conduit fluidly connecting the second container to the valve, the method comprising:

providing a wash out assembly including a third container having water and a third conduit fluidly connecting the third container to the valve;

adjusting the valve to direct the first chemical product from the first container, through the first conduit, valve, and device conduit, and into the mixing device;

adjusting the valve to direct water from the wash out assembly, through the valve and device conduit, and into the mixing device to wash out the first chemical product from the valve and the device conduit;

adjusting the valve to direct the second chemical product from the second container, through the second conduit, valve, and device conduit, and into the mixing device;

pumping water from the primary water source; and mixing the second chemical product with the water from the primary water source within the mixing device.

13. The method of claim 12, further comprising mixing within the mixing device one of the first chemical product from the first container, the second chemical product from the second container, and the water from the washout assembly with water being pumped by the pump from a water source.

* * * * *